US006547557B2

(12) United States Patent
Lemke

(10) Patent No.: US 6,547,557 B2
(45) Date of Patent: Apr. 15, 2003

(54) WATER-COOLABLE FURNACE ROLLER FOR CONVEYING CONTINUOUS-CAST STRIP MATERIAL WORKPIECES THROUGH A ROLLER HEARTH FURNACE

(75) Inventor: Jürgen Lemke, Malliss (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/952,025

(22) Filed: Sep. 13, 2001

(65) Prior Publication Data

US 2002/0048740 A1 Apr. 25, 2002

(30) Foreign Application Priority Data

Sep. 13, 2000 (DE) ..... 100 45 251

(51) Int. Cl.[7] ..... F28F 5/02
(52) U.S. Cl. ..... 432/236; 492/46
(58) Field of Search ..... 432/60, 228, 236; 492/37, 46; 165/89; 219/469

(56) References Cited

U.S. PATENT DOCUMENTS 3,976,423 A * 8/1976 Schmidt ..... 432/236
5,341,568 A * 8/1994 Bricmont et al. ..... 432/236
5,421,724 A * 6/1995 Facco ..... 432/236

FOREIGN PATENT DOCUMENTS

| | | |
|---|---|---|
| DE | 3807240 | 6/1989 |
| DE | 4022768 | 8/1999 |
| EP | 0633815 | 9/1997 |

* cited by examiner

*Primary Examiner*—Gregory Wilson
(74) *Attorney, Agent, or Firm*—Friedrich Kueffner

(57) ABSTRACT

A water-coolable furnace roller for conveying goods to be transported through a roller hearth heating furnace has a shaft supported external to the furnace and driven in rotation. The shaft has an outer contact surface. Support rings having a receiving bore, respectively, are arranged with the receiving bore on the shaft, wherein the support rings form a conveying plane. The receiving bore has an inner contact surface, and at least one of the inner and the outer contact surfaces has a shape of a polygon contour of substantially constant diameter with fitting surfaces defining an orbiform curve.

14 Claims, 2 Drawing Sheets

WATER-COOLABLE FURNACE ROLLER FOR CONVEYING CONTINUOUS-CAST STRIP MATERIAL WORKPIECES THROUGH A ROLLER HEARTH FURNACE

BACKGROUND OF THE INVENTION

1. Field of the Invention

The invention relates to a water-coolable furnace roller for transporting goods to be transported, in particular, continuous-cast strip material of a continuous casting plant, through a roller hearth heating furnace. The furnace roller comprises a shaft driven in rotation and supported external to the furnace. The shaft has cooling medium channels positioned, in particular, in the interior and comprises support rings for supporting the goods to be transported which are arranged on the shaft by means of receiving bores and form a conveying plane.

2. Description of the Related Art

Thin slabs are, for example, pre-heated to rolling temperature in roller hearth furnaces of continuous casting plants. Conveying the rolling stock or the slabs through the roller hearth furnaces is carried out by means of furnace rollers of different configurations. The roller hearth furnace is positioned conventionally in line between the casting device and the mill train and is characterized by its function as a heating, compensation, and buffering zone. As a result of the types of stress of furnace rollers during the furnace operation, the furnace roller types of the prior art have a service live of different lengths.

The dimensions of such furnaces and its devices for heat application, for example, burners, are designed such that at the exit of the furnace the thin slabs have the required rolling temperature. In this connection, a uniform temperature distribution in the slab over its length, width, and height at the furnace exit is a mandatory prerequisite for the subsequent rolling action. The furnace length allows several thin slabs to be received which, after casting at different casting speeds, are separated from the cast strand.

The transport of such thin slabs is carried out within the furnace by means of driven furnace rollers. They are arranged at a certain furnace height at a level—the transport level—at predetermined spacings relative to one another. Relatively speaking, the dimensions of the rollers are characterized in that the diameter of the support rings and of the shafts are small in comparison to the length of the rollers.

The transport rollers in the roller hearth furnaces can be provided with water cooling, but can also be without a cooling device, i.e., they are so-called dry rollers.

The conventional configuration of water-cooled rollers comprises several support rings arranged at an axial spacing to one another on the water-cooled shaft. The latter is insulated between the support rings with refractory material, wherein this insulating layer is almost as thick as the outer diameter of the support rings.

The shaft is supported external to the furnace and provided in this external area with connectors for the inner cooling of the shaft. This inner cooling is achieved by a tube with circular cross-section which is arranged concentrically in the shaft. Cooling water flows into the tube, then flows through the tube to the opposite side of the furnace, and flows at the other side into the annular gap between the tube and the shaft, flows therethrough, and finally exits the shaft at the inlet side. In the annular gap between the shaft and the inserted tube, insert members in the widest sense of the meaning of the word can be provided which have the objective to secure the tube in the radial position and to increase the flow velocity of the water in the annular gap.

The support rings mounted on the roller axle are comprised conventionally of cast material and are produced of high temperature-resistant nickel-based or cobalt-based alloys. The shaft is preferably manufactured of heat-resistant steels.

The water-cooled rollers are used primarily, but not exclusively, in the heating zone of a roller hearth furnace. In the transport direction, they are alternatingly provided with different numbers of support rings. Conventionally, the shafts are provided with four or five support rings, usually alternatingly. In this connection, in the transport direction from one roller provided with four support rings to a roller with five support rings, the support rings are located on different lines. The roller with four support rings has two of its support rings positioned on one half of the shaft, respectively, while on the roller with five support rings one roller is arranged at the center of the roller and the others are positioned so as to be laterally outwardly staggered relative to the support rings on the roller with four support rings.

In the prior art the support rings are secured on the shaft against axial movement usually by welding seams. The torque can be transmitted by known shaft/hub connections, for example, feather keys, but also by welding seams.

As a result of the thermal expansion of the support ring material during heating as well as in the operating state, the seat of the support rings on the shaft will loosen. Reverse bending fatigue stress of the furnace roller as well as the intended higher heat dissipation from the support ring surface to the cooling water at the inner side of the shaft cause, primarily during the heating phase, thermal stress in the welding seams which, over time, can lead to their destruction and to unusable furnace rollers.

An important reason for failure of a furnace roller is the damage or destruction of the insulation of the roller because, in particular, by this event, the welding seams are directly exposed to the high furnace temperatures.

By contact between the support ring and the water-cooled shaft, the heat is dissipated from the support ring surface, and the surface temperature of the support rings is thus significantly reduced. The more heat is dissipated, the cooler the support ring surface becomes. The cooler the support ring surface, the lower the tendency of scale deposition and pick-up thereon.

During the manufacture of, for example, thin slabs, hot steel comes into contact with oxygen in the atmosphere. Accordingly, the steel surface is oxidized with formation of scale. Such scale formation occurs basically everywhere where oxygen is available in the surrounding gas medium for reaction with the steel surface.

During the transport of a thin slab through the furnace, the scale falls off the billet surface and is removed through scale flaps in the lower part of the roller hearth furnace. On the other hand, during the contact of the thin slabs and the furnace roller in the roller hearth furnace scale can adhere to the support ring surface and can form deposits thereon, which can be pressed into the thin slab underside and, depending on the depth of the hot strip to be rolled therefrom, can appear as a surface flaw. Such flaws then cause rejects and thus represent a severe quality problem for the slab manufacturer.

The prior art document DE 40 22 768 describes a roller table with rollers for conveying and guiding a workpiece through a heating furnace. The rollers comprise shafts whose ends are rotatably supported in bearings. They form wheel-like support devices which, in the longitudinal direction of the shaft, are fastened at a spacing from one another on the outer shaft periphery. The surfaces of the wheel-like support devices which are positioned in the radial direction farthest outwardly are provided as supports for the workpiece while it is being guided through the heating furnace. The wheel-like support devices are comprised of a hub which are connected by ribs with a wheel rim-like continuous ring structure. The ribs are separated from one another by open spaces in order to reduce their cross-sectional surface area and to thus make the thermal flow from the annular structure to the hub more difficult. The hub is comprised of several core members arranged angularly at a spacing to one another and having a nose-like portion and a head portion. A welding seam connects exclusively the nose-like portions with the shaft so that the head portions can move relative to the shaft as a result of different expansion as well as during bending. Means for thermal insulation of the shaft are substantially the portions between neighboring wheel-like support devices and the walls of the furnace. The devices for rotating the shaft are arranged external to the furnace.

The document EP 0 633 815 B1 describes a furnace roller for supporting a heated workpiece. The furnace roll has a rotatable shaft for receiving a cooling medium wherein a number of support rings arranged with axial spacing to one another are fastened thereon. A thermally-resistant insulating material which is mounted about the shaft extends axially between the support rings wherein the insulation means has an outer surface which extends radially across at least a significant portion of the radius of a support ring pair. The insulation means is fastened on the shaft by means of anchoring means wherein projecting end pieces are arranged radially inwardly relative to outer surface of the insulating means. The spacer is made of a metal which makes possible a stress reduction in regard to the thermal expansion of the anchoring means and deflection of the furnace roller for the castable insulating material.

The prior art document DE 38 07 240 C1 describes a roller hearth furnace for heating slabs, ingots, billets, sheet metal and the like hot stock whose furnace space is provided with a longitudinally extending roller table. The furnace has a hot top furnace space and a bottom furnace space and therebetween a hearth bottom with recesses. The roller table is substantially supported in the bottom furnace space below the hearth bottom and projects only with small portions of its furnace rollers through the recesses of the hearth bottom above this level. At least the roller portions projecting into the heating zone with their running surfaces on which the hot stock is transported is comprised of particularly heat-resistant material which, comprised of segments combined to a ring, envelopes the peripheral surface of the furnace roller. Cleaning devices free the running surface of the furnace rollers from scale deposits.

U.S. patent application Ser. No. 09/952,025 suggests that the shaft, at least at the receiving areas of the support rings, has outer seat surfaces which form a polygon-like cross-section and that each support ring is provided with corresponding polygon-like positive-locking inner fitting surfaces for the purpose of improving the heat transfer between the support rings and the shaft, in particular, in order to increase the heat dissipation from the support rings to the shaft and to thus extend the availability of the support rings while providing a reduced formation of scale thereon and, at the same time, to ensure a safe torque transmission as well as, for a reduced labor expenditure, to achieve greater flexibility for mounting the support rings on the shaft.

SUMMARY OF THE INVENTION

It is an object of the present invention to provide means for a further improvement of the heat transfer between the support rings and the shaft in order to thus increase the heat dissipation from the support rings onto the shaft and to extend the availability of the support rings with reduced formation of scale thereon and, at the same time, to ensure a reliable and safe torque transmission between the support rings and the shaft. At the same time, a greater flexibility for its arrangement is to be achieved while requiring a reduced labor expenditure for mounting of the support rings on the shaft.

In accordance with the present invention, this is achieved in that, for providing an optimal metallic contact for a heat transfer as unimpeded as possible between the support ring and the shaft, the inner contact surfaces at the inner diameter (inner surface) of the receiving bore of the support ring and/or the outer contact surfaces at the outer diameter (outer surface) of the shaft are formed as a polygon contour of a substantially constant diameter with fitting surfaces, i.e., it is formed as a so-called weak orbiform curve.

This configuration of the transition area between the support ring and the shaft in the form of a deviation from the ideal round shape, i.e., a circular shape, provides advantageously an automatic tightening of the support ring seat on the shaft when torque is transmitted. Moreover, the inner contact surface of the support ring as well as the outer contact surface of the shaft are plastically and elastically deformed which has the result of a substantial increase of the contact areas and by which, as a further advantage, a considerably improved thermal conduction or considerably improved heat transfer between the support ring and the shaft results.

This also achieves compensation of the inner diameter of the support ring, which increases with heat expansion, by a rotation relative to the shaft. In total, with the configuration according to the invention, as a result of the enlarged inner contact surface of the support ring and of the outer contact surface of the shaft and a more intimate metallic contact, the surface temperature of the furnace roller is reduced and its availability is increased and the risk of a scale pick-up formation at its surface is reduced.

Further advantages result in that the spacing between the support rings on the shaft is freely selectable. Accordingly, the configuration of the furnace roller is extremely flexible and can be optimally adjusted to the respective requirements and loads.

Moreover, the configuration is simplified because the torque transmission between the shaft and the support ring requires no additional parts.

With the use of thin shims which increase additionally the heat transfer in the contact area shaft/support ring, the heat transfer can be further improved.

DESCRIPTION OF THE PREFERRED EMBODIMENTS

Figure 1:
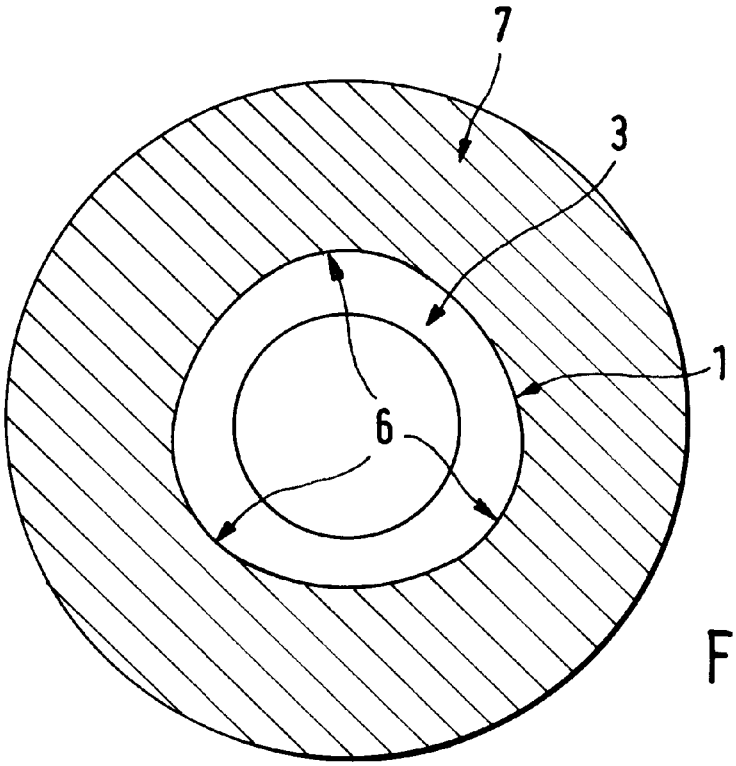
FIG. 1 shows a support ring in an end view with the shaft shown in section and the fitting surfaces of a weak orbiform curve in the initial mounted state.

In FIG. 1 the support ring 7 and shaft 3 shown in section are illustrated in the initial mounted position with snug fit 6 with minimal deviation of a polygon profile of a few millimeters from the circular shape. This is a so-called weak "orbiform curve".

The shaft 3 has in its tubular hollow space a central cooling medium channel 4 with a peripheral annular cooling medium channel 5.

Figure 2:
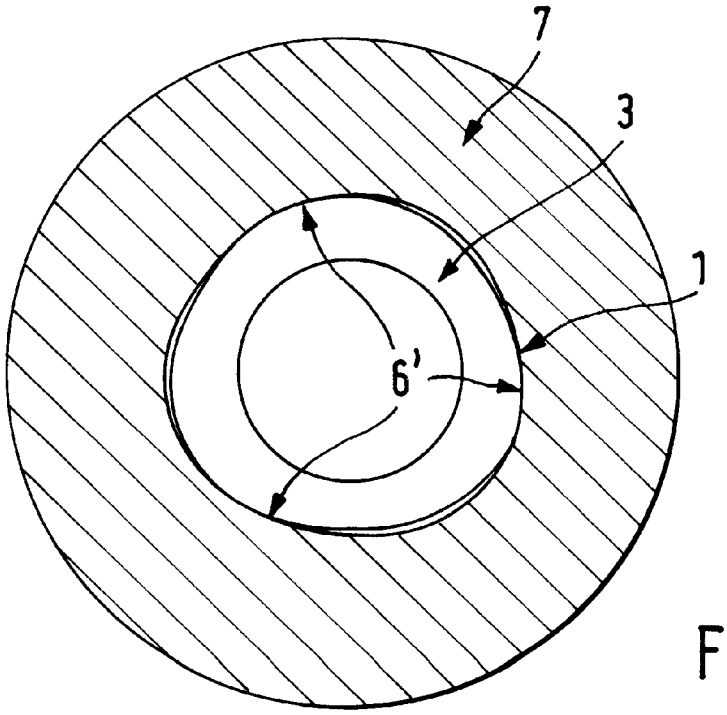
FIG. 2 is a support ring according to FIG. 1 in an operational state after heating.

FIG. 2 shows the support ring 7 with the shaft 3 shown in section in the operational state under load by torsional strain and in the heated state.

The preferred configuration of the contact surface(s) as an orbiform curve provides that the deviation of the fitting surfaces 6, 6' from the ideal round shape, i.e., the circular shape, provides a self-locking action upon torque transmission between the support ring 7 and the shaft 3. This deviation of the fitting surfaces 6, 6' from the ideal round shape, depending on the embodiment and mechanical and/or thermal loading, is approximately 1 to 5 mm.

The support ring 7 is pushed and secured (clamped) purely mechanically on the shaft 3 by relative rotation of the shaft 3 by means of the fitting tolerances (6, 6') of the orbiform curve wherein the attachment of the support ring 7 and of the shaft 3 is realized by the principle of surface enlargement by deformation of the fitting surfaces 6, 6'.

The deviation of the fitting surfaces 6, 6' from the ideal round shape should be at least slightly greater than the heat expansion of the inner diameter of the receiving bore 1 of the support ring 7 during operation of the furnace. This receiving bore 1 forms in this connection the inner contact surface (6) with the counter surface (6') of the shaft 3.

Moreover, the invention suggests that the metallic contact is realized by the orbiform curve either over the entire width of the furnace roller or about portions thereof. The support ring 7 can be a single ring member or comprised of multiple ring members, for example, can be comprised of individual rings.

When manufacturing the furnace roller, thin shims, for example, of silver foil or foil of a resistant and high heat-conducting metal, for example, CuNiBe, can be inserted between the support ring 7 and the shaft 3, in particular, in its multi-part configuration.

Figure 3:
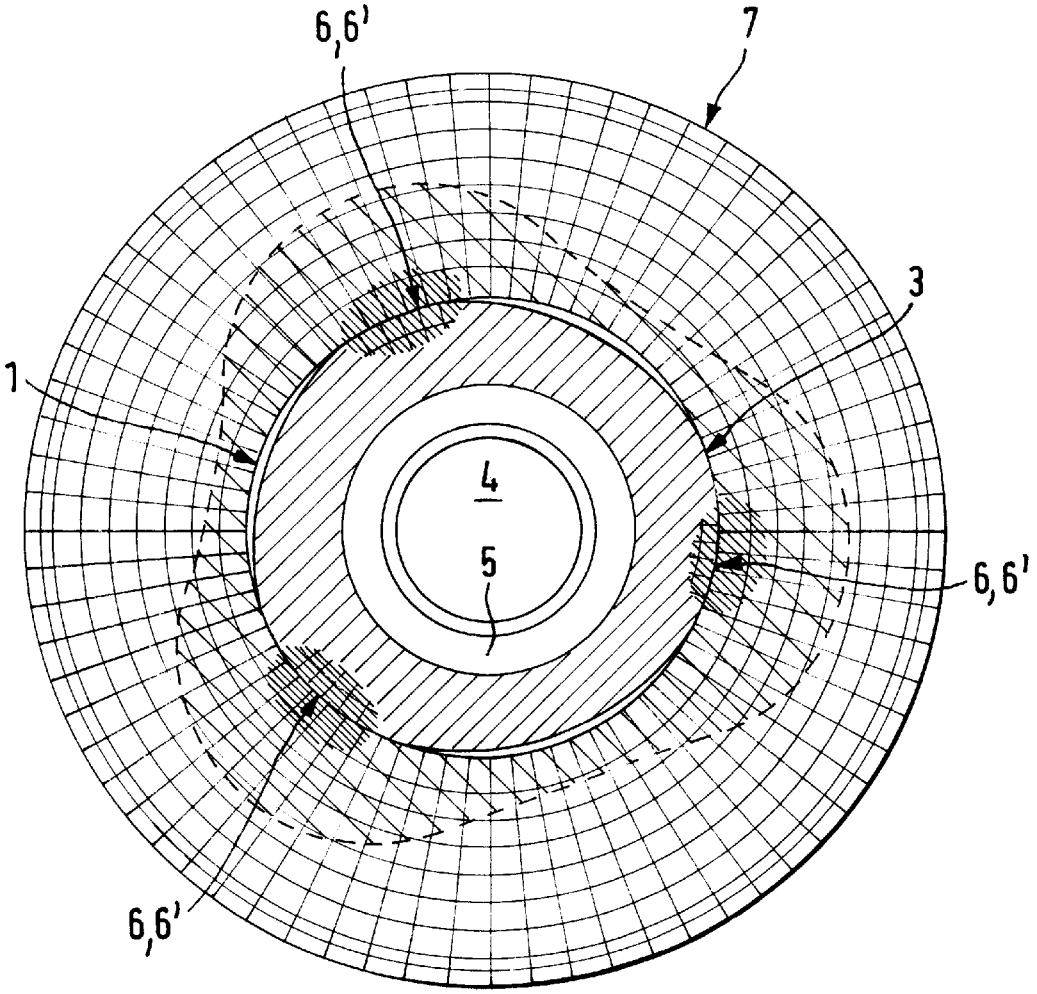
FIG. 3 is a support ring and shaft in an end view and partially in section with snug fit as an orbiform curve with approximately 1.7 mm deviation from the circular shape in a heat diagram.

FIG. 3 shows a configuration of the invention wherein the orbiform curve in the form of a polygon profile with constant diameter has such weak fitting tolerances between the inner contact surfaces at the inner diameter (inner surface) of the support ring 7 and the outer contact surfaces of the outer diameter (outer surface) of the shaft 3 that a rotation of the support ring 7 and the shaft 3 as a result of the transmission of torque results in a comparatively great elastic-plastic deformation.

At the deformation areas 6, 6' optimal metallic contact with ideal thermal conducting conditions are present and make possible an unimpeded heat transfer from the support rings 7 into the shaft 3 as is illustrated in the heat diagram of FIG. 3.

While specific embodiments of the invention have been shown and described in detail to illustrate the inventive principles, it will be understood that the invention may be embodied otherwise without departing from such principles.

What is claimed is:

1. A water-coolable furnace roller for conveying goods to be transported through a roller hearth heating furnace, the furnace roller comprising:

a shaft configured to be supported external to the furnace and to be driven in rotation;

the shaft having an outer contact surface;

support rings having a receiving bore, respectively, and arranged with the receiving bore on the shaft, wherein the support rings form a conveying plane;

wherein the receiving bore has an inner contact surface and wherein at least one of the inner and the outer contact surfaces has a shape of a polygon contour of substantially constant diameter with fitting surfaces defining an orbiform curve, wherein the fitting surfaces have a deviation from a circular shape and wherein the deviation provides a self-locking action when torque is transmitted between the support ring and the shaft, and wherein the deviation of the fitting surfaces from the circular shape is substantially 4% to 5%.

2. The furnace roller according to claim 1, wherein the receiving bore has an inner diameter and wherein the deviation of the fitting surfaces from the circular shape matches at least a magnitude of thermal expansion of the inner diameter of the receiving bore during furnace operation.

3. The furnace roller according to claim 1, wherein a metallic contact provided by the orbiform curve is realized across portions of the width of the furnace roller.

4. The furnace roller according to claim 1, wherein the support ring is comprised of several ring members.

5. The furnace roller according to claim 1, wherein the support ring is composed of individual rings.

6. The furnace roller according to claim 1, comprising thin shims arranged between the support ring and the shaft.

7. The furnace roller according to claim 6, wherein the thin shims are comprised of silver foil or a foil of a resistant and highly thermally conducting material.

8. The furnace roller according to claim 7, wherein the resistant and highly thermally conducting material is CuNiBe.

9. The furnace roller according to claim 6, wherein the support ring is comprised of several ring members or of individual rings.

10. The furnace roller according to claim 1, wherein the orbiform curve has such weak fitting tolerances between the inner contact surface of the receiving bore and the outer contact surface of the shaft that a rotation of the support ring and the shaft relative to one another as a result of torque transmission results in a comparatively significant elastic-plastic deformation.

11. The furnace roller according to claim 1, wherein the shaft has inner cooling medium channels.

12. The furnace roller according to claim 1, wherein the goods to be transported are continuous-cast products of a continuous casting plant.

13. A water-coolable furnace roller for conveying goods to be transported through a roller hearth heating furnace, the furnace roller comprising:

a shaft configured to be supported external to the furnace and to be driven in rotation;

the shaft having an outer contact surface;

support rings having a receiving bore, respectively, and arranged with the receiving bore on the shaft, wherein the support rings form a conveying plane;

wherein the receiving bore has an inner contact surface and wherein at least one of the inner and the outer contact surfaces has a shape of a polygon contour of substantially constant diameter with fitting surfaces defining an orbiform curve, wherein a metallic contact provided by the orbiform curve is realized across the entire width of the furnace roller.

14. A water-coolable furnace roller for conveying goods to be transported through a roller hearth heating furnace, the furnace roller comprising:

a shaft configured to be supported external to the furnace and to be driven in rotation;

the shaft having an outer contact surface;

support rings having a receiving bore, respectively, and arranged with the receiving bore on the shaft, wherein the support rings form a conveying plane;

wherein the receiving bore has an inner contact surface and wherein at least one of the inner and the outer contact surfaces has a shape of a polygon contour of substantially constant diameter with fitting surfaces defining an orbiform curve, wherein the support ring is a single ring member.

* * * * *